US008065826B2

(12) United States Patent
Riis et al.

(10) Patent No.: US 8,065,826 B2
(45) Date of Patent: Nov. 29, 2011

(54) LABEL WITH A FORMABLE CUP

(76) Inventors: Mogens Riis, Hedehusene (DK); Jorgen Hansen, Glostrup (DK)

( * ) Notice: Subject to any disclaimer, the term of this patent is extended or adjusted under 35 U.S.C. 154(b) by 0 days.

(21) Appl. No.: 12/158,790

(22) PCT Filed: Dec. 21, 2006

(86) PCT No.: PCT/DK2006/000736

§ 371 (c)(1),
(2), (4) Date: Oct. 21, 2008

(87) PCT Pub. No.: WO2007/071254

PCT Pub. Date: Jun. 28, 2007

(65) Prior Publication Data

US 2009/0188143 A1 Jul. 30, 2009

(30) Foreign Application Priority Data

Dec. 23, 2005 (DK) ..... 2005 01827

(51) Int. Cl.
*G09F 3/00* (2006.01)

(52) U.S. Cl. ..... 40/310; 40/324; 215/DIG. 7

(58) Field of Classification Search ..... 40/310, 40/324; 206/217, 218; 215/DIG. 7; 220/62; 229/4.5, 405; 428/47
See application file for complete search history.

(56) References Cited

U.S. PATENT DOCUMENTS

| | | | | | |
|---|---|---|---|---|---|
| 1,109,162 | A | * | 9/1914 | Claussen | 206/218 |
| 1,289,218 | A | * | 12/1918 | Maiden | 215/6 |
| 1,453,015 | A | * | 4/1923 | Lavigne | 229/405 |
| 1,738,779 | A | * | 12/1929 | Lockwood | 229/405 |
| 1,742,279 | A | * | 1/1930 | Reynolds | 206/218 |
| 2,263,122 | A | * | 11/1941 | De Haven | 215/395 |
| 2,323,288 | A | * | 7/1943 | Amberg | 229/400 |
| 2,925,208 | A | | 2/1960 | Wood | |
| 2,967,609 | A | * | 1/1961 | Gabbard | 206/218 |
| 3,262,596 | A | * | 7/1966 | Zillmann | 215/390 |
| 3,363,750 | A | * | 1/1968 | Smith | 206/218 |
| 3,994,089 | A | * | 11/1976 | Schwartz | 40/310 |
| 4,387,804 | A | * | 6/1983 | Austin | 206/218 |
| 4,626,455 | A | * | 12/1986 | Karabedian | 428/34.7 |
| 5,024,014 | A | * | 6/1991 | Swierczek | 40/310 |

FOREIGN PATENT DOCUMENTS

| | | |
|---|---|---|
| DE | 10302012 | 7/2003 |
| EP | 1512527 | 3/2005 |
| JP | 9020342 | 1/1997 |
| JP | 2000238758 | 9/2000 |
| JP | 2002080045 | 3/2002 |
| WO | 9118800 | 12/1991 |
| WO | 0126980 | 4/2001 |

* cited by examiner

*Primary Examiner* — Joanne Silbermann
*Assistant Examiner* — Christopher e Veraa
(74) *Attorney, Agent, or Firm* — Volentine & White, PLLC

(57) ABSTRACT

The present invention relates to a label (1) comprising at least one formable cup in the form of at least one cup sheet (2), and to a drinking system (100) comprising a container (102) with a label comprising at least one cup sheet (2). The label (1) comprises at least one cup sheet (2), each cup sheet (2) having an outer edge (12), a first surface, and a second surface (58), wherein the at least one cup sheet (2) is detachable from the label (1) and formable such that the at least one cup sheet (2) can be formed into at least one cup.

21 Claims, 6 Drawing Sheets

LABEL WITH A FORMABLE CUP

CROSS REFERENCE TO RELATED APPLICATIONS

This application is the national phase under 35 U.S.C. 371 of PCT International Application No. PCT/DK2006/000736 which has an international filing date of Dec. 21, 2006, and also claims priority under 35 U.S.C. 119 to Danish application PA 2005 01827 filed on Dec. 23, 2005, which applications are hereby incorporated by reference in their entirety for all purposes as if fully set forth herein.

The present invention relates to a label comprising at least one formable cup in the form of at least one cup sheet, and to a drinking system comprising a container with a label comprising at least one cup sheet.

BACKGROUND OF THE INVENTION

Disposable cups are well known in the art. However bringing along disposable cups can be space consuming and inconvenient. Furthermore, disposable cups are not always easy to get hold of in situations where one has forgotten cups or has not realized the need. Further, disposable cups may be broken during transport.

SUMMARY OF THE INVENTION

Accordingly, there is a need for a disposable cup that is easy to bring and does not take up a lot of space.

According to a first aspect of the present invention a label is provided, comprising at least one cup sheet, each cup sheet having an outer edge, a first surface, and a second surface, wherein the at least one cup sheet is detachable from the label and formable such that the at least one cup sheet can be formed into at least one cup.

Further, a drinking system is provided, comprising a container with a label comprising at least one cup sheet, each cup sheet having an outer edge, a first surface, and a second surface, wherein the at least one cup sheet is detachable from the label and formable such that the at least one cup sheet can be formed into at least one cup.

It is an important advantage of the present invention that the at least one cup sheet can be formed into at least one cup without the use of a tool.

Furthermore, the present invention provides at least one cup that takes up little space during transportation, which makes is easy to bring along where limited luggage compartment capacity is available, e.g. on a picnic, on the beach, etc.

The label according to the present invention may comprise one or more cup sheets, e.g. a plurality of cup sheets, such as two, three, four, five, or more cup sheets, wherein each cup sheet has an outer edge, a first surface, and a second surface, and is detachable from the label and formable such that each cup sheet can be formed into a cup.

Preferably, the label according to the present invention comprises a label frame. The label frame may support the at least one cup sheet and function as a carrier for respective cup sheet or cup sheets. The label frame may have at least one inner edge. Each inner edge may extend along the outer edge of each of the at least one cup sheets.

The cup sheet may be formed into a cup by folding, pressing, unfolding, shaping and/or other suitable operations.

In the following, when referring to a cup sheet or to the cup sheet it is to be understood that there may be at least one cup sheet, such as two, three or more cup sheets.

A separation line may be formed between the outer edge of a cup sheet and an inner edge of the label frame. The separation line may be a continuous cut or a weakened line. For example, a plurality of perforations may be provided between the outer edge of the cup sheet and the inner edge of the label frame for enabling detachment of the cup sheet from the label frame.

An outer edge of the cup sheet may be connected at least partly to an inner edge of the label frame, e.g. along a separation line having a plurality of interspaced perforations.

The at least one cup sheet may be attached to the label frame by adhesion. In one embodiment of the present invention, the first surface of the cup sheet is adhered to a surface of the label frame.

It is an advantage of the present invention that a cup formed from a cup sheet may be able to stand on a flat surface. According to the invention, the cup sheet may thus comprise a first part. The first part may have a first edge forming a part of the outer edge of the cup sheet. The first part may form a substantially flat bottom of the cup.

The cup sheet may comprise a second part. Preferably, the second part forms at least one sidewall of the formed cup. The formed cup may comprise one or a plurality of sidewalls, such as one, two, three, four or more sidewalls. The second part may have at least one edge that is adapted to form the top of the formed cup.

The cup sheet may comprise a first fixation part. The first fixation part may have an adhesive surface. The adhesive surface of the first fixation part may be adapted to adhere to a surface of the first part and/or the second part to form a cup. The first fixation part may comprise one or more fixation tabs.

The cup sheet may comprise a second fixation part. The second fixation part may have an adhesive surface. The adhesive surface of the second fixation part may be adapted to adhere to a surface of the first part and/or the second part to form a cup.

The cup sheet may comprise one or more folding lines, such as one, two, three, four or more folding lines, to facilitate forming of the two-dimensional cup sheet to a three-dimensional cup. Preferably, folding lines are provided between some of the different parts of the cup sheet, e.g. between the first part and the second part and/or between the first fixation part and the second part.

The first part, the second part, the first fixation part, and the second fixation part of the cup sheet have first and second surfaces, respectively. The first surfaces of the first part, the second part, the first fixation part, and the second fixation part at least partly form the first surface of the cup sheet, and the second surfaces of the first part, the second part, the first fixation part, and the second fixation part at least partly form the second surface of the cup sheet.

Preferably, the cup sheet comprises at least one layer of a polymer material, such as one, two, three, or more layers of a polymer material. The polymer material may be any suitable polymer material comprising at least one polymer and/or a mixture or combination of different polymers depending on the desired properties of the polymer material. Suitable polymer materials include e.g. polyethylene, polyester, polypropylene, etc.

The cup sheet may comprise at least one layer of fiber material. A fiber material layer may comprise any suitable fiber material or a combination of one or more fiber materials, such as cellulose fibers, polymer fibers, or any other suitable fiber material having desired properties.

The label has a first surface and a second surface. A suitable adhesive, e.g. a conventional adhesive known in the art, may be applied to one of the surfaces of the label, e.g. the first surface of the label, for adhesion to a container.

An adhesive may be applied to a surface of one or more parts of the cup sheet for providing an adhesive surface, e.g. an adhesive may be applied to the first surface of the first fixation part and/or an adhesive may be applied to the first surface of the second fixation part. In one embodiment, an adhesive is applied to the first surface of the first fixation part for providing an adhesive surface. The adhesive may be any adhesive that is suitable for gluing different parts of the cup sheet to form a formed cup. Furthermore, the adhesive must be non-toxic. Preferably, fluids such as water and/or alcohol do not dissolve the adhesive.

The label according to the invention comprises a base layer. Further, the label may comprise one or more laminate layers, such as one, two, three, four or more laminate layers. Respective layers of the label may be put together by e.g. gluing, heat sealing or other suitable methods. Adhesives may be provided between different layers and/or different parts of the label.

In one embodiment of the present invention, the cup sheet forms a part of the base layer.

In one embodiment of the present invention, the cup sheet forms a part of all layers of the label.

In a preferred embodiment, the label has a base layer and a first laminate layer, wherein the base layer and a part of the first laminate layer constitute a label frame. The at least one cup sheet having a first surface and a second surface constitutes a part of the first laminate layer. The first laminate layer of the label frame is separated from the first laminate layer of the cup sheet along the separation line with a continuous cut forming the outer edge of the cup sheet. At least a part of the first surface of the cup sheet is adhered to the label frame with a suitable adhesive.

In another preferred embodiment of the present invention, the label has a base layer, a first laminate layer and a second laminate layer, wherein the base layer, a part of the first laminate layer and a part of the second laminate layer constitute a label frame. The at least one cup sheet having a first surface and a second surface constitutes a part of the first laminate layer and a part of the second laminate layer. The first laminate layer and the second laminate layer of the label frame is separated from the first laminate layer and the second laminate layer of the cup sheet along the separation line with a continuous cut forming the outer edge of the cup sheet. The first surface of the cup sheet is adhered to the base layer of the label frame with a suitable adhesive.

The surfaces of the different layers in the label may be adhesive either due to the properties of the layer material or due to an adhesive applied on the surface of the layer in question.

The label according to the invention may have any suitable thickness, such as in the range from about 0.02 mm to about 4 mm, preferably in the range from about 0.1 mm to about 1.5 mm, more preferably in the range from 0.2 mm to about 1 mm such as about 0.4 mm.

The label according to the invention may comprise at least one cup sheet folded along one or more folding lines such that the cup sheet constitute two or more layers of the label. Thus a cup may be formed from a cup sheet without the need for gluing together different parts of the cup sheet.

The container of the drinking system may have any suitable shape and size and be made of any suitable material. The container may be formed as a bottle, or a can, and may be made of any suitable material such as glass, metal, such as aluminum, other suitable metals or alloys, polymers, such as polyethylene, or others.

The label may be attached to the container in any suitable way. In one embodiment of the present invention, the label is glued and/or heat-sealed to the container. Alternatively or in combination, the label may be shrunk around the container, thereby attaching the label to the container.

The cup sheet of a label according to the invention may be formed into a container of any suitable shape, such as a cup, a glass, a mug, a jug, or a goblet, for holding any beverages or food in general, e.g. such as water, milk, beer, soft drinks, soup, etc.

The present invention provides an easy and convenient way of providing a drinking container in situations where bringing along separate disposable cups is inconvenient. Furthermore, the label is relatively cheap and thus eliminates the need for buying and bringing additional drinking containers.

BRIEF DESCRIPTION OF THE DRAWINGS

The present invention will now be described in further detail with reference to the enclosed drawings, wherein.

DETAILED DESCRIPTION OF THE INVENTION

Figure 1:
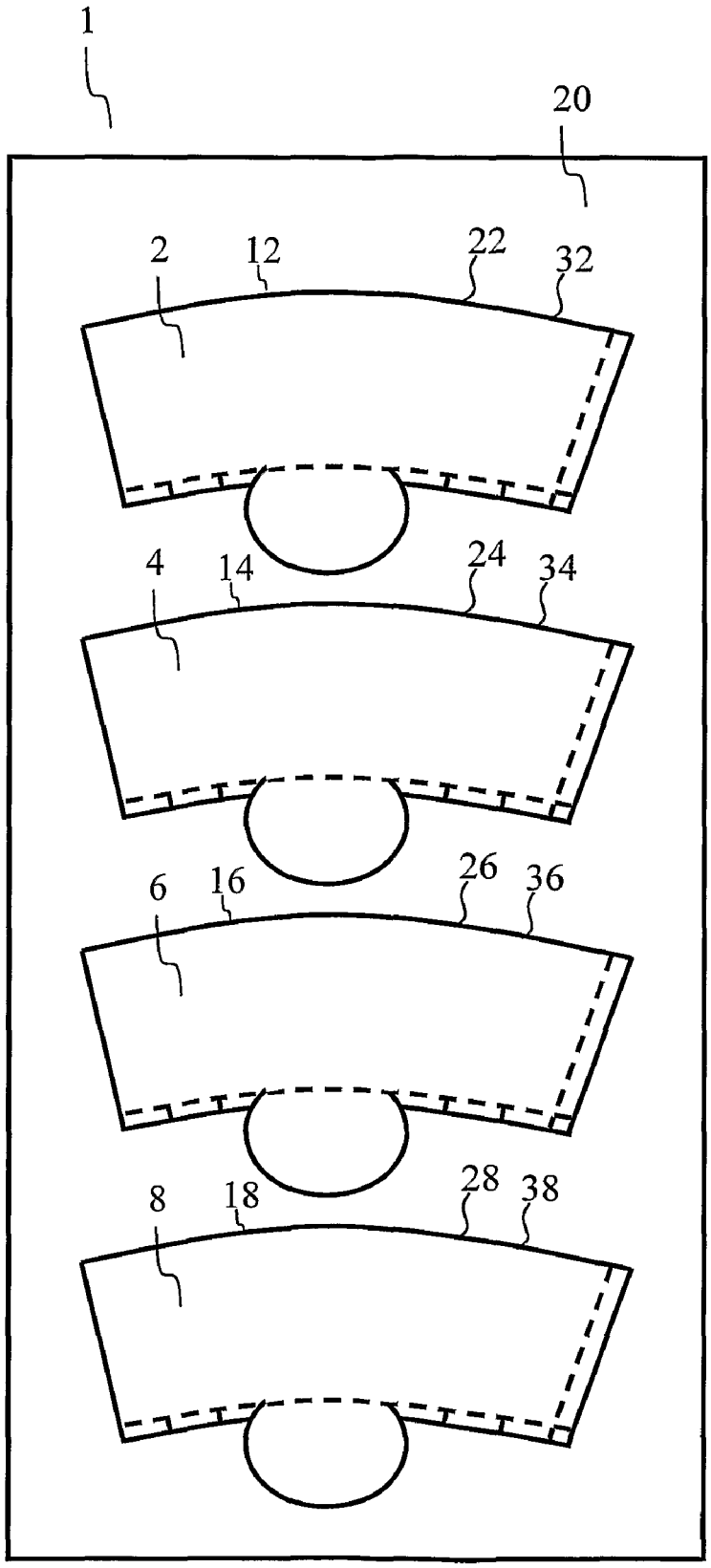
FIG. 1 shows one embodiment of a label according to the invention.

In all figures, like reference numerals indicate like elements or features.

FIG. 1 shows an embodiment of a label according to the present invention. The label 1 comprises a first cup sheet 2, a second cup sheet 4, a third cup sheet 6, and a fourth cup sheet 8, and each of the cup sheets 2, 4, 6, 8 has an outer edge 12, 14, 16, 18, a first surface, and a second surface, respectively, wherein the cup sheets 2, 4, 6, 8 are detachable from the label and formable such that each of the cup sheets can be formed into a cup. The second surface is visible in FIG. 1. The label 1 has a label frame 20, which carries the cup sheets 2, 4, 6, 8. In this embodiment of the present invention, the label frame 20 and the cup sheets 2, 4, 6, 8 form a part of the same layer. Thus, the label frame 20 comprises a first inner edge 22, a second inner edge 24, a third inner edge 26, and a fourth inner edge 28 forming a first separation line 32, a second separation line 34, a third separation line 36, and a fourth separation line 38 with the first outer edge 12, the second outer edge 14, the third outer edge 16, and the fourth outer edge 18, respectively. In FIG. 1, the cup sheets 2, 4, 6, 8 have the same size and shape. In another embodiment the sizes and/or shapes of the different cup sheets may vary according to desired sizes and shapes of the cups.

Figure 2:
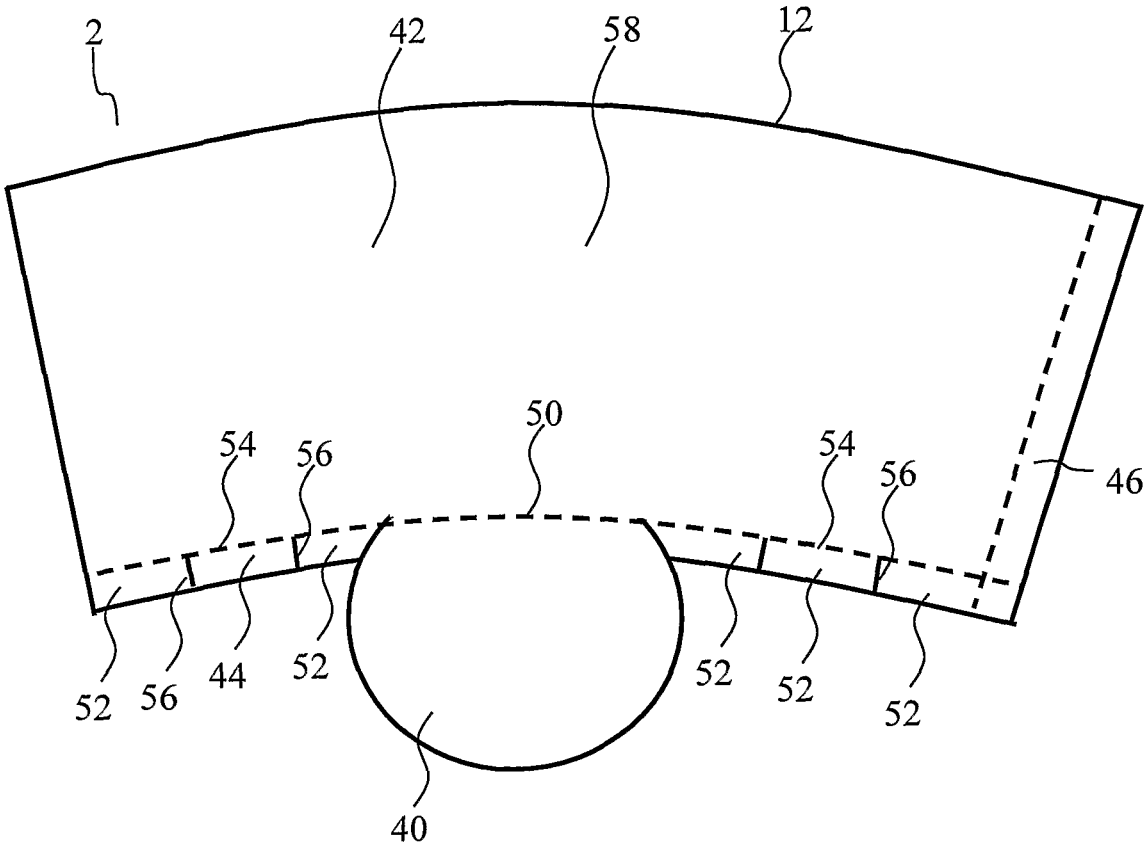
FIG. 2 shows one of the cup sheets from the label in FIG. 1 in more detail.

FIG. 2 shows the cup sheet 2 detached from the label frame 20. The cup sheet 2 comprises a first part 40, a second part 42, a first fixation part 44, and a second fixation part 46. A first folding line 50 is provided between the first part 40 and the second part 42 to make forming of the cup sheet easier. In this embodiment, the first fixation part 44 comprises a plurality of fixation tabs 52, and a second folding line 54 is provided between the fixation tabs 52 and the second part 42. The fixation tabs 52 are separated by cuts 56 extending from or near the second folding line 54 towards the outer edge 12 of the cup sheet 2. The cup sheet 2 has a first surface and a visible second surface 58. In this embodiment, an adhesive is applied to the first surface of the fixation tabs 52 such that a part of the second surface of the first part 40 can be fixed to the fixation tabs 52 to form a watertight cup. Further, an adhesive is applied to the first surface of the second fixation part 46 such that a part of the second surface of the second part 42 can be fixed to the second fixation part 46 to form a watertight cup.

Figure 3:
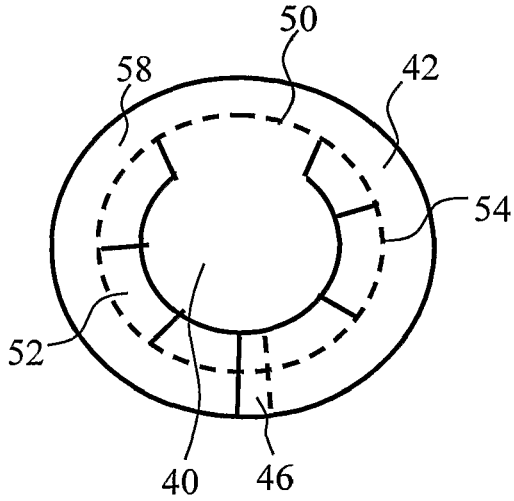
FIG. 3 shows a cup formed from the cup sheet in FIG. 2 seen from below.

FIG. 3 shows a schematic view of a cup formed from the cup sheet 2 seen from below. The first surfaces of the fixation tabs 52 are adhesively fixed to the second surface of the first part 40. The first surface of the second fixation part 46 is adhesively fixed to the second surface of the second part 42. The first part 40 forms the bottom of the cup and the second part 42 forms the sidewall of the cup.

Figure 4:
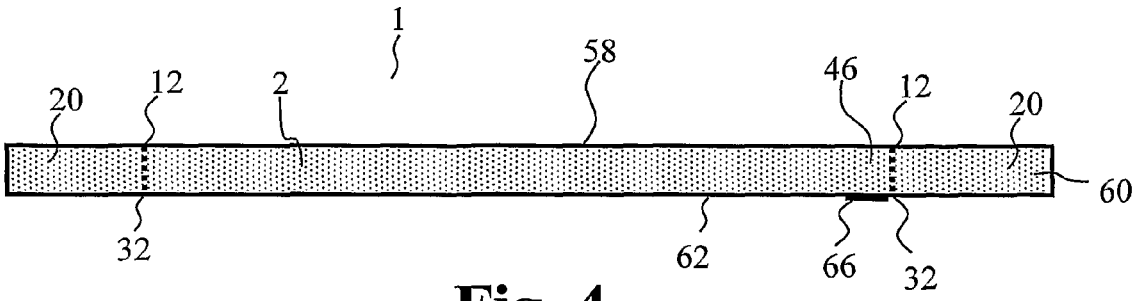
FIG. 4 is a schematic cross section of one embodiment of a label according to the invention.

FIG. 4 shows a schematic cross section of an embodiment of the label according to the invention. The label 1 has a base layer 60 comprising a first cup sheet 2 having a first surface 62, a second surface 58, and a first outer edge 12 attached to the label frame 20 along a first separation line 32. The separation line 32 is a weakened line formed by a plurality of perforations along the first outer edge of the first cup sheet 2 and the first inner edge of the label frame 20. An adhesive 66 is applied on the first surface of the second fixation part 46.

Figure 5:
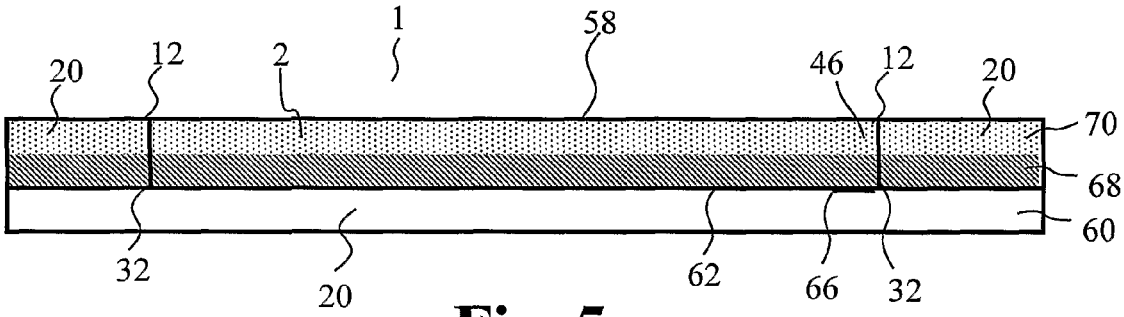
FIG. 5 is a schematic cross section of another embodiment of a label according to the invention.

FIG. 5 shows a schematic cross section of another embodiment of the label according to the invention. The label 1 has a base layer 60, a first laminate layer 68, and a second laminate layer 70. The label 1 comprises a first cup sheet 2 forming a part of the first laminate layer 68 and the second laminate layer 70. The first cup sheet 2 has a first surface 62 facing the base layer 60, a second surface 58, and a first outer edge 12. The base layer 60, a part of the first laminate layer 68 and a part of the second laminate layer 70 constitute a label frame 20. A first separation line 32 is formed in the first laminate layer and the second laminate layer by a continuous cut along the first outer edge of the first cup sheet and the first inner edge of the label frame. The first cup sheet 2 is detachably fixed to the base layer 60 by means of an adhesive and/or an adhesive surface of the base layer 60. An adhesive 66 is applied on the first surface of the second fixation part 46.

Figure 6:
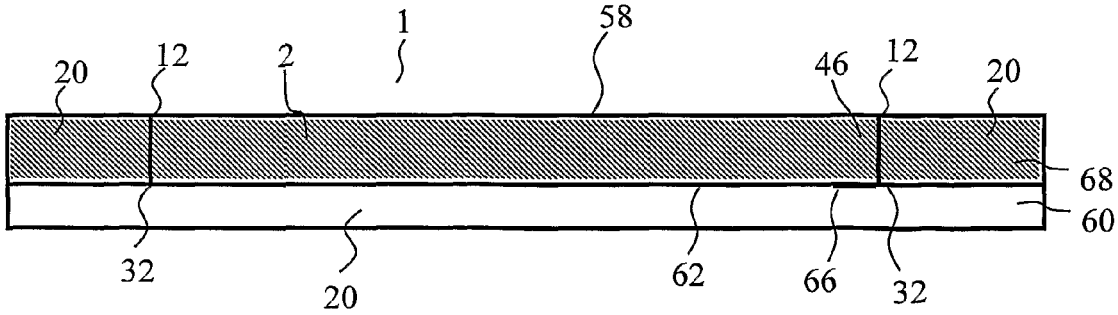
FIG. 6 is a schematic cross section of yet another embodiment of a label according to the invention.

FIG. 6 shows a schematic cross section of yet another embodiment of the label according to the invention. In this embodiment, the label 1 has a base layer 60 and a first laminate layer 68. The label 1 comprises a first cup sheet 2 forming a part of the first laminate layer 68. The first cup sheet 2 has a first surface 62 facing the base layer 60, a second surface 58, and a first outer edge 12. The base layer 60 and a part of the first laminate layer 68 constitute a label frame 20. A first separation line 32 is formed in the first laminate layer 68 by a continuous cut along the first outer edge of the first cup sheet and the first inner edge of the label frame. The first cup sheet 2 is detachably fixed to the base layer 60 by means of an adhesive and/or an adhesive surface of the base layer 60. An adhesive 66 is applied on the first surface of the second fixation part 46.

Figure 7:
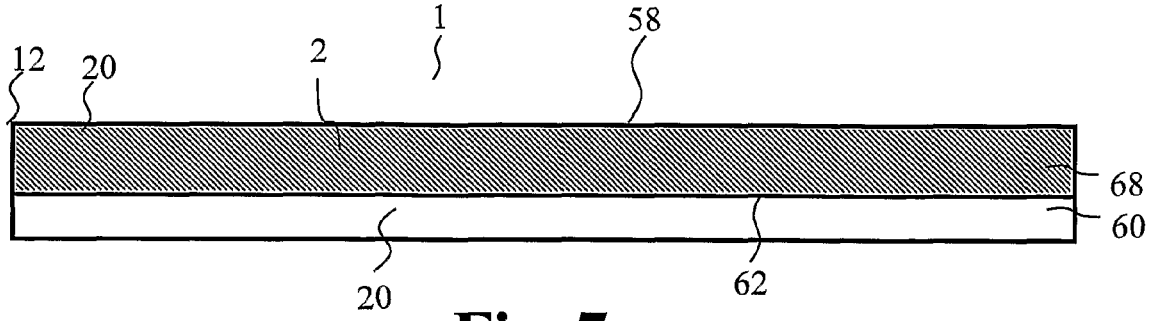
FIG. 7 is a schematic cross section of yet another embodiment of a label according to the invention.

FIG. 7 shows a schematic cross section of yet another embodiment of the label according to the invention.

Figure 8:
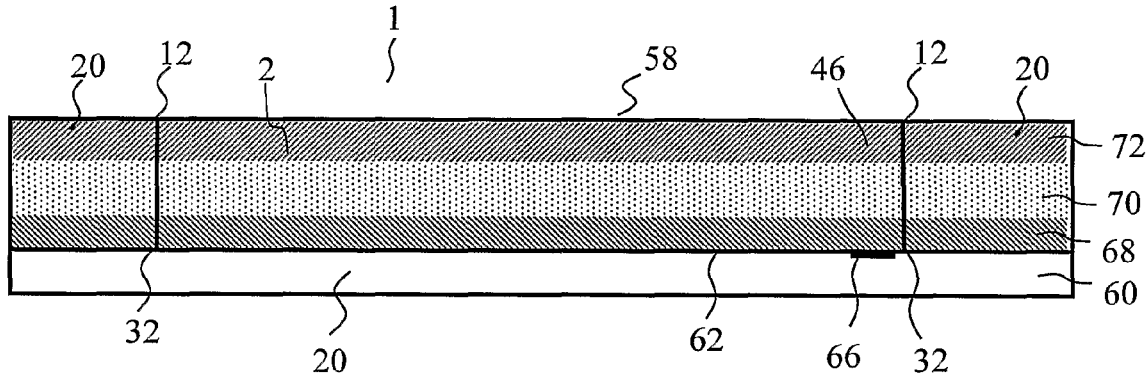
FIG. 8 is a schematic cross section of yet another embodiment of a label according to the invention.

FIG. 8 shows a schematic cross section of another embodiment of the label according to the invention. The label 1 has a base layer 60, a first laminate layer 68, a second laminate layer 70, and a third laminate layer 72. The label 1 comprises a first cup sheet 2 forming a part of the first laminate layer 68, a part of the second laminate layer 70, and a part of the third laminate layer 72. The first cup sheet 2 has a first surface 62 facing the base layer 60, a second surface 58, and a first outer edge 12. The base layer 60, a part of the first laminate layer 68, a part of the second laminate layer 70, and a part of the third laminate layer 72 constitute a label frame 20. A first separation line 32 is formed in the first laminate layer, in the second laminate layer, and in the third laminate layer 72 by a continuous cut along the first outer edge of the first cup sheet and the first inner edge of the label frame. The first cup sheet 2 is detachably fixed to the base layer 60 by means of an adhesive and/or an adhesive surface of the base layer 60. An adhesive 66 is applied on the first surface of the second fixation part 46.

Figure 9:
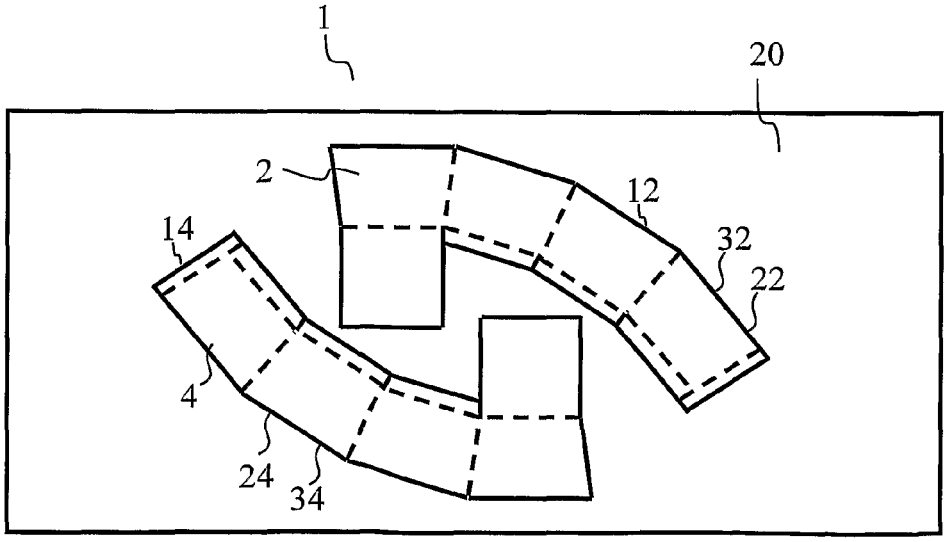
FIG. 9 shows another embodiment of the label according to the invention.

FIG. 9 shows an alternative embodiment of a label according to the invention.

Figure 10:
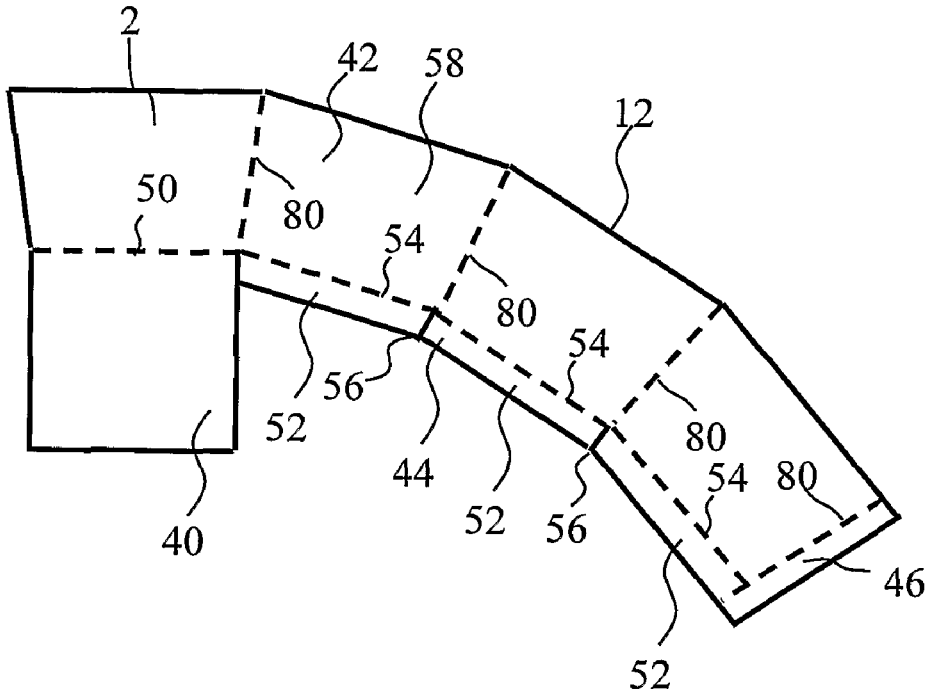
FIG. 10 shows one of the cup sheets from the label in FIG. 9 in more detail.

FIG. 10 shows a cup sheet from FIG. 9 in more detail. Folding lines 80 divide the second part 42 in four part for forming four sidewalls in a cup.

Figure 11:
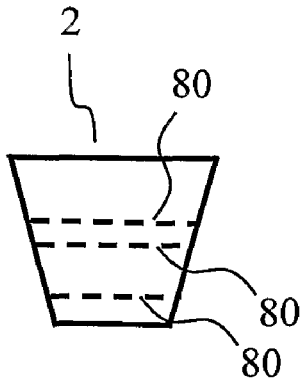
FIG. 11 shows a cup formed from a cup sheet of a label according to the invention.

FIG. 11 shows side view of a cup formed from a cup sheet of a label according to the invention. The cup sheet comprises folding lines 80. In this embodiment, the label comprises at least one cup sheet folded along the folding lines 80 such that the cup sheet in some parts of the label constitute two or more layers of the label. In this embodiment, the cup sheet is made of a flexible material having a suitable resilience. This embodiment of the invention provides a cup that can be formed from a cup sheet without the need for gluing together different parts of the cup sheet.

Figure 12:
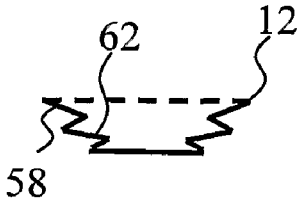
FIG. 12 is a schematic cross section of the cup sheet in FIG. 11.

FIG. 12 is a cross section of the cup sheet in FIG. 11 folded along the folding lines 80. The first surface 62 of the cup sheet constitutes the inside of the cup.

Figure 13:
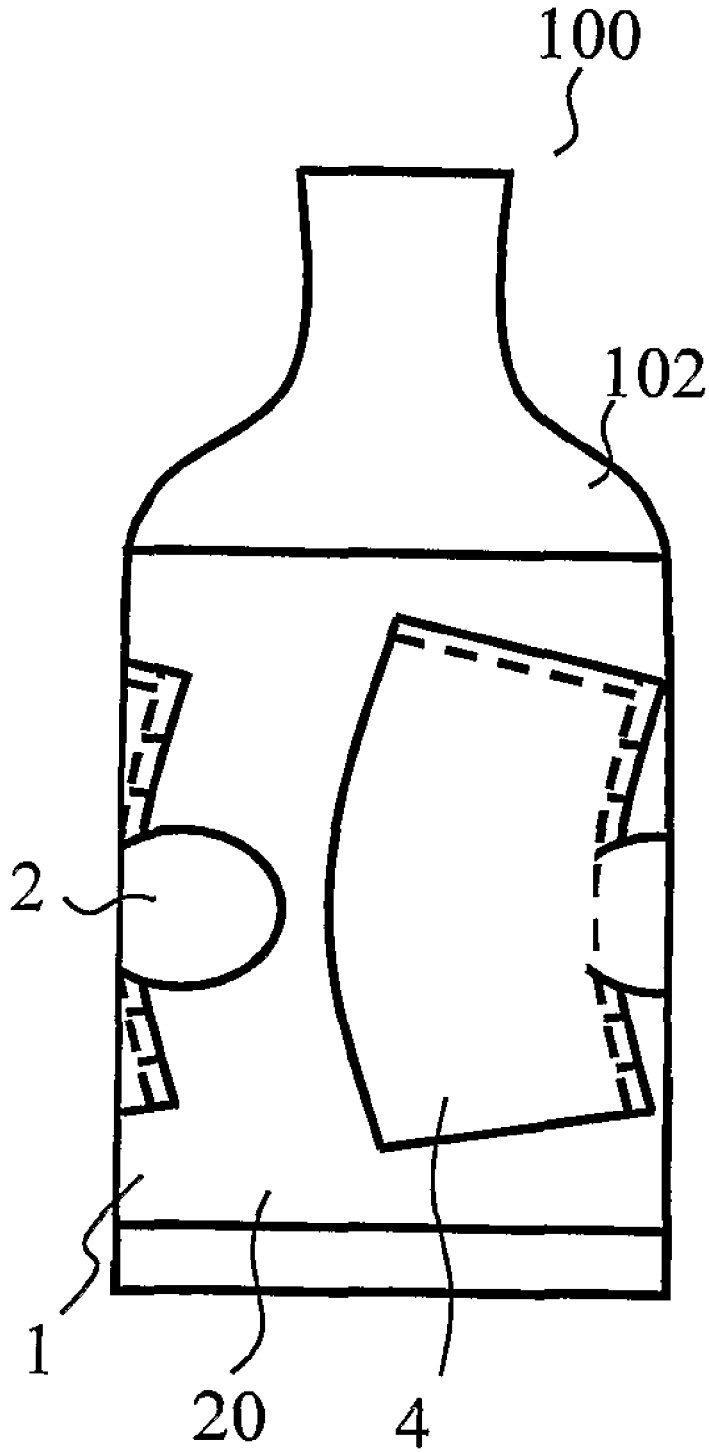
FIG. 13 is a schematic view of an embodiment of a drinking system according to the invention.

FIG. 13 shows an embodiment of a drinking system according to the invention. The drinking system 100 comprises a container 102 with a label 1 comprising at least one cup sheet 2, 4. Each cup sheet has an outer edge, a first surface, and a second surface, wherein the at least one cup sheet is detachable from the label and formable such that the at least one cup sheet can be formed into at least one cup. In this embodiment of the drinking system at least a part of the label is glued or heat-sealed to either the container or to another part of the label for fixing the label to the container.

The invention claimed is:

1. A label comprising:

a label frame comprising a base layer; and a plurality of cup sheets, each cup sheet having an outer edge, a first surface, and a second surface, wherein the first surface of each of the cup sheets is respectively contacted to the base layer of the label frame, and the plurality of cup sheets are detachable from the label frame, wherein each of the cup sheets comprises a first part for forming the bottom of a cup, a second part for forming at least one sidewall of the cup, and at least one folding line between the first part and the second part such that the plurality of cup sheets can be formed into a plurality of cups, wherein the first surface of each cup sheet is formable to be an interior surface of a respective cup.

2. A label according to claim 1, wherein separation lines are formed between the outer edges of the cup sheets and inner edges of the label frame.

3. A label according to claim 2, wherein the separation lines are weakened lines.

4. A label according to claim 1, wherein the cup sheets are attached to the label frame by adhesion.

5. A label according to claim 1, wherein the at least one cup sheet further comprises a first fixation part.

6. A label according to claim 5, wherein the first fixation part has an adhesive surface.

7. A label according to claim 5, wherein the at least one cup sheet further comprises a second fixation part.

8. A label according to claim 7, wherein the second fixation part has an adhesive surface.

9. A label according to claim 1, wherein each cup sheet comprises a layer of a polymer material.

10. A label according to claim 1, wherein each cup sheet comprises a layer of paper material.

11. A label according to claim 1, wherein an adhesive is applied to at least a part of one side of the label.

12. A label according to claim 1, wherein the label comprises a first laminate layer.

13. A label according to claim 12, wherein the plurality of cup sheets form a part of the first laminate layer.

14. A label according to claim 12, wherein the label further comprises at least a second laminate layer.

15. A label according to claim 14, wherein the plurality of cup sheets form a part of the second laminate layer.

16. A drinking system comprising:

a container, and a label according to claim 1, the label being attached to the container.

17. A drinking system according to claim 16, wherein the label is attached to the container by shrinking of the label.

18. A drinking system according to claim 16, wherein the label is attached to the container by gluing.

19. A drinking system according to claim 17, wherein the label is attached to the container by gluing.

20. A label comprising:

a base layer;

a label frame adhesively attached on the base layer; and a plurality of cups sheets each disposed on the base layer and each having an outer edge detachably connected to the label frame by a separation line, wherein each cup sheet is bordered by the label frame so as to be separated apart from the other cup sheets on the base layer and is part of a same layer as the label frame.

21. A label according to claim 20, wherein the cup sheets each include a first surface facing the base layer, a second surface opposite the first surface, and at least one folding line, wherein the first surface of each cup sheet is foldable along the at least one fold line to be an interior surface of a respective cup.

* * * * *